US009137599B2

(12) United States Patent
Reuter et al.

(10) Patent No.: US 9,137,599 B2
(45) Date of Patent: Sep. 15, 2015

(54) UNDERWATER SENSOR ARRAYS LINEARIZED BY WEIGHT AND BUOYANCE DISTRIBUTION

(75) Inventors: Jeffrey A. Reuter, Hollis, NH (US); William S. Terry, Danville, NH (US); Robert J. Nation, Deerfield, NH (US); Kenneth Baldwin, Durham, NH (US); Jud DeCew, Rochester, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 442 days.

(21) Appl. No.: 13/592,464

(22) Filed: Aug. 23, 2012

(65) Prior Publication Data

US 2013/0229894 A1 Sep. 5, 2013

Related U.S. Application Data

(60) Provisional application No. 61/526,497, filed on Aug. 23, 2011.

(51) Int. Cl.

| | |
|---|---|
| ***H04R 1/44*** | (2006.01) |
| *H04R 1/40* | (2006.01) |
| *H04R 3/00* | (2006.01) |

(52) U.S. Cl.
CPC *H04R 1/44* (2013.01); *H04R 1/406* (2013.01); *H04R 3/005* (2013.01)

(58) Field of Classification Search
CPC ..... H04R 1/44; H04R 1/406; H04R 3/005
USPC ..... 367/154, 173, 165
See application file for complete search history.

(56) References Cited

U.S. PATENT DOCUMENTS

| | | | | | |
|---|---|---|---|---|---|
| 3,277,429 | A | * | 10/1966 | Hammond, Jr | 367/4 |
| 3,372,368 | A | * | 3/1968 | Dale et al. | 367/154 |
| 3,711,821 | A | * | 1/1973 | Dale et al. | 367/3 |
| 4,266,500 | A | * | 5/1981 | Jurca | 441/29 |
| 4,958,328 | A | * | 9/1990 | Stubblefield | 367/15 |
| 5,117,396 | A | * | 5/1992 | Castile et al. | 367/153 |
| 5,379,267 | A | * | 1/1995 | Sparks et al. | 367/18 |
| 5,412,622 | A | * | 5/1995 | Pauer et al. | 367/154 |
| 6,418,082 | B1 | * | 7/2002 | Hollis et al. | 367/118 |
| 2013/0229894 | A1 | * | 9/2013 | Reuter et al. | 367/154 |

* cited by examiner

*Primary Examiner* — Daniel Pihulic
(74) *Attorney, Agent, or Firm* — Daniel J. Long

(57) ABSTRACT

A system and method for linearizing underwater sensor arrays is disclosed. The sensor array comprises slightly positive or negative buoyant sensors that are positioned along a cable. A weight is positioned at a deep end of the cable or a buoyant object is positioned at a shallow end of the cable, but not both. Distributing buoyant elements throughout the length of the array generates more consistent, uniformly distributed tension, enabling the sensor array to maintain a linear shape in currents of all strengths and speeds.

16 Claims, 8 Drawing Sheets

Prior Art- Floating

Prior Art- Anchored

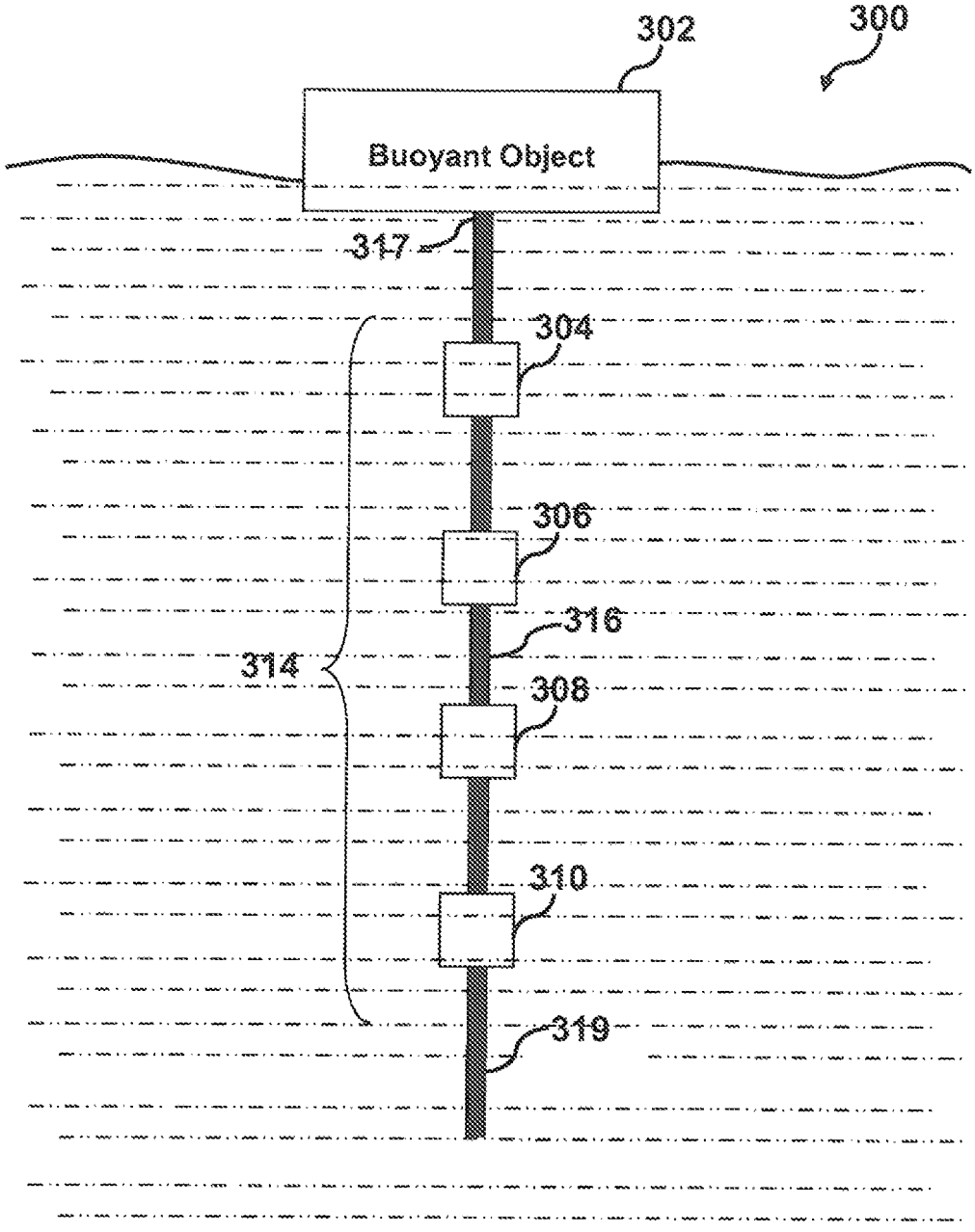
FIG. 3A FLOATING

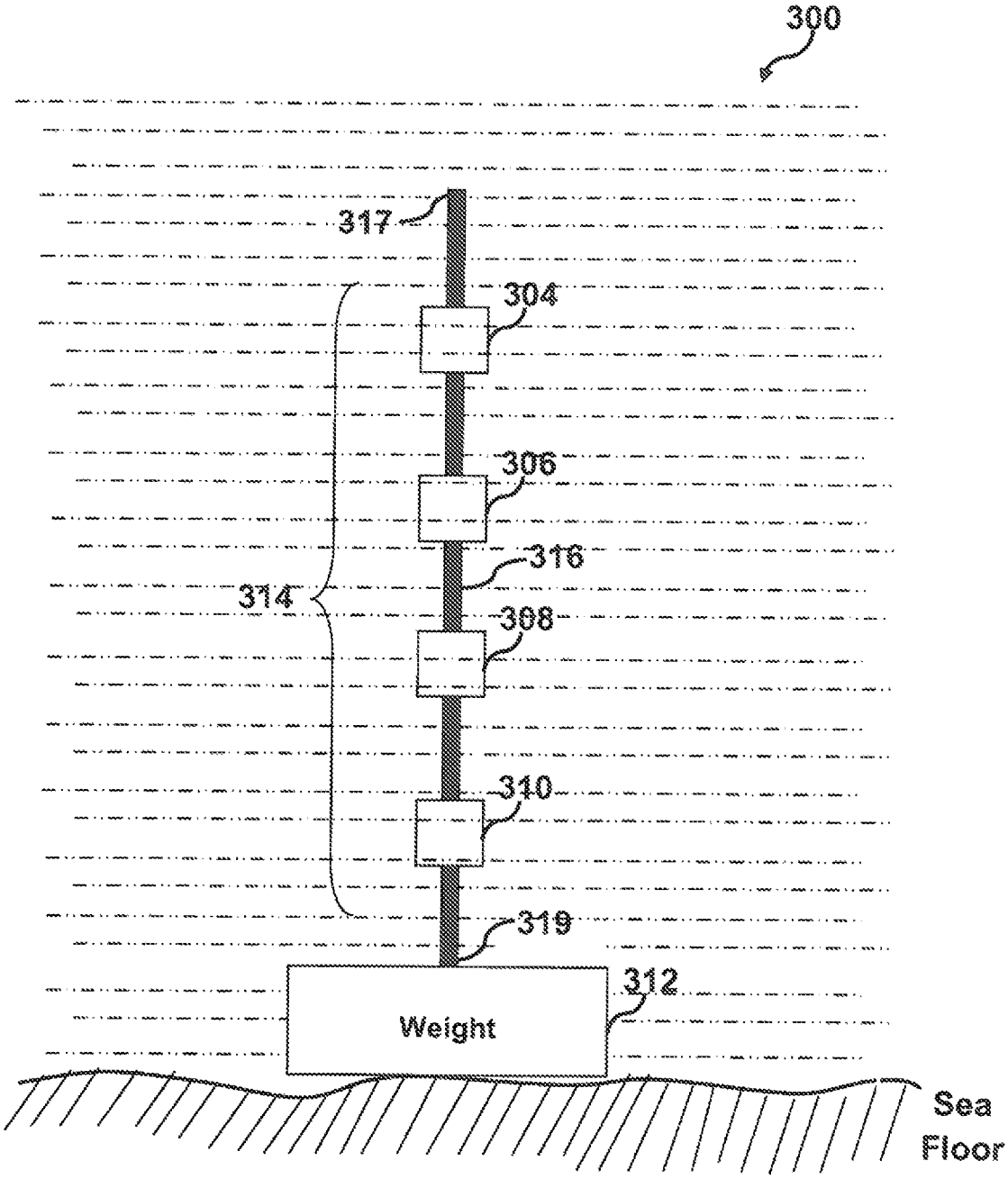
FIG. 3B ANCHORED

UNDERWATER SENSOR ARRAYS LINEARIZED BY WEIGHT AND BUOYANCE DISTRIBUTION

RELATED APPLICATIONS

This Application claims rights under 35 USC §119(e) from U.S. Application Ser. No. 61/526,497 filed Aug. 23, 2011, the contents of which are incorporated herein by reference.

TECHNICAL FIELD

Embodiments are generally related to sensor systems. Embodiments are also related to orienting underwater sensor arrays. Embodiments are additionally related to a system and method for linearizing underwater sensor arrays by weight and buoyancy distribution.

BACKGROUND OF THE INVENTION

Underwater sensor arrays are important tools with both military and civilian applications. For civilian research purposes, sensor arrays can be used to identify and track sea life and make other scientific measurements. In a military context, sensor arrays can be strategically placed and monitored in order to identify and track all surface ships, submarines, and other waterborne objects. To prevent errors within integrated electronic circuits caused by SEUs and SETs, the current passing through CML gates can be increased. Increasing the current within an integrated circuit, however, increases the circuit's power consumption and requires larger system components. As a result of increasing the current flowing through CML gates, the gates become ineffectual for small technology nodes. Small technology nodes cannot withstand the increased power usage due to the size of node's internal components.

Referring to FIG. 1A and FIG. 1B a traditional sensor array system 100 with floating and anchoring application is disclosed. The system 100 is positioned underwater in a vertical orientation and comprises a sensor array 114. The sensor array 114 comprises a plurality of neutrally buoyant sensors 104, 106, 108 and 110 positioned along a cable 116. The deep end 119 of the cable 116 is usually weighted, and a buoyant object 102 is typically attached to the shallow end 117. The acoustic sensors 104, 106, 108 and 110 are neutrally buoyant, thus leaving the bottom weight 112 and shallow buoyant object 102 to create tension and neutralize the distributed weight of the cable 116. Specialized algorithms known as beam forming algorithms use the distributed locations of the acoustic sensors to identify, locate, and track objects in the water.

The traditional sensor array forms a curved shape, when subjected to ocean currents. FIG. 2 shows the curved shape 200 of a traditional sensor array depicted in FIG. 1A and FIG. 1B when anchored to the sea floor, and placed in a typical ocean current of fifty eight centimeters per second. This curved geometry significantly complicates beam forming algorithms and signal processing, thereby causing location estimates to be less accurate, impeding identification, and reducing processing efficiency.

A linear shape of sensor arrays is ideal for performance of the beam forming algorithms and accordant signal processing. A need therefore exists for a system and method for linearizing underwater sensor arrays. Also such system and method should generate more consistent and localized tension and enable the acoustic array to maintain a linear shape in ocean currents of varying strengths and speeds.

SUMMARY

The following summary is provided to facilitate an understanding of some of the innovative features unique to the disclosed embodiment and is not intended to be a full description. A full appreciation of the various aspects of the embodiments disclosed herein can be gained by taking the entire specification claims, drawings, and abstract as a whole.

It therefore, one aspect of the disclosed embodiments to provide sensor systems.

It is another aspect of the disclosed embodiments to provide a method of orienting underwater sensor arrays.

It is yet another aspect of the disclosed embodiments to provide a system and method for linearizing underwater sensor arrays by weight and buoyancy distribution.

The aforementioned aspects and other objectives and advantages can now be achieved as described herein. A system and method for linearizing underwater sensor arrays by distributing the buoyancy throughout the sensors in an array is disclosed. For arrays suspended from a float on the surface, as shown in FIG. 3A, the invention utilizes slightly negatively-buoyant sensors rather than concentrating the weight at the bottom of the array. For arrays anchored to the bottom of the ocean, as shown in FIG. 3B, the invention utilizes a plurality of slightly buoyant sensors rather than concentrating the buoyancy at the top of the array. Distributing buoyant elements throughout the length of the array generates more consistent, uniformly distributed tension, enabling the sensor array to maintain a linear shape in currents of substantially all strengths and speeds.

BRIEF DESCRIPTION OF THE DRAWINGS

The accompanying figures, in which like reference numerals refer to identical or functionally-similar elements throughout the separate views and which are incorporated in and form a part of the specification, further illustrate the disclosed embodiments and, together with the detailed description of the invention, serve to explain the principles of the disclosed embodiments.

FIG. 3A and FIG. 3B illustrates schematic diagram of an underwater sensor array system, in accordance with the disclosed embodiments;

DETAILED DESCRIPTION

Figure 1A:
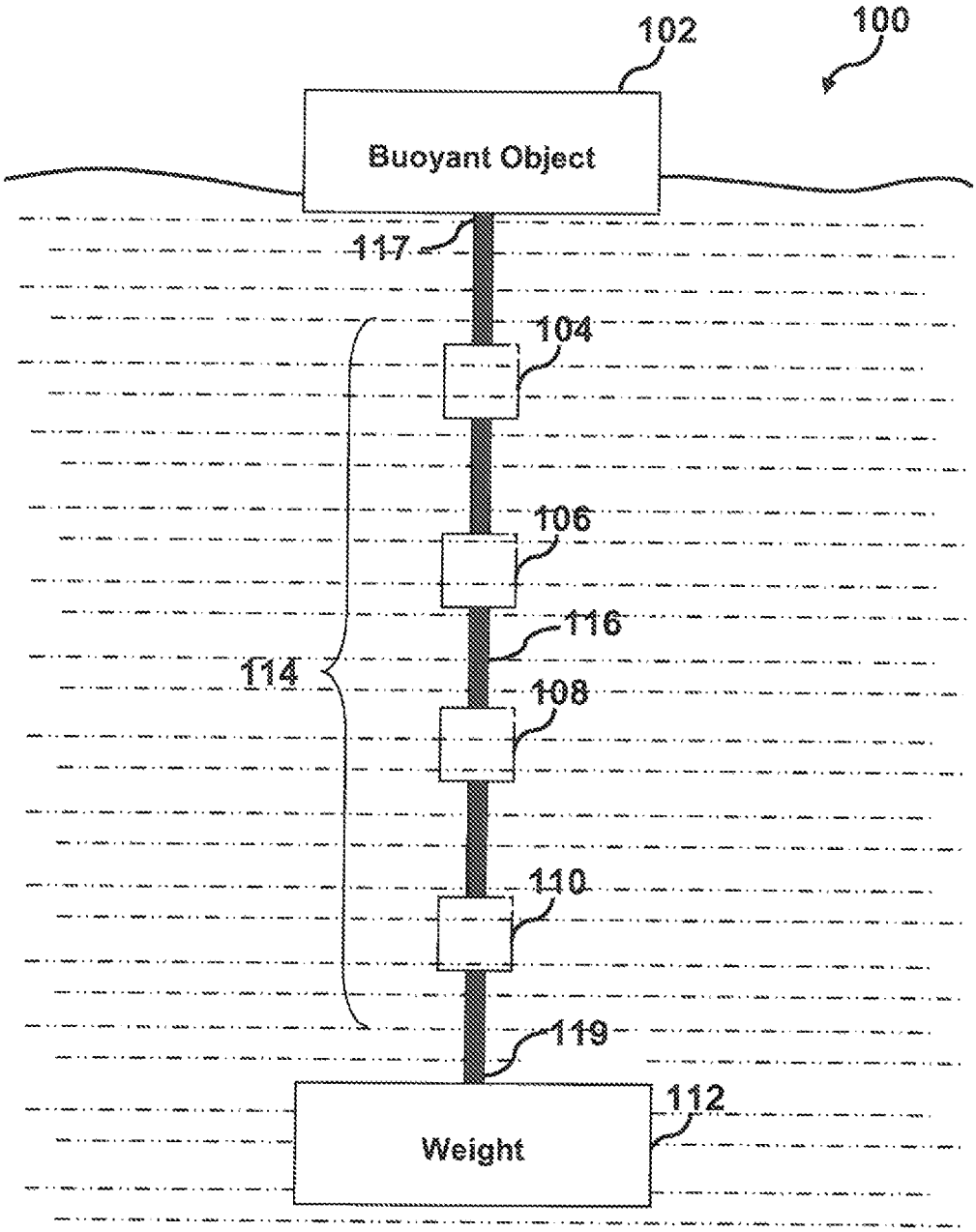
FIG. 1A and FIG. 1B illustrates schematic diagram of a traditional underwater sensor array system.
Figure 1B:
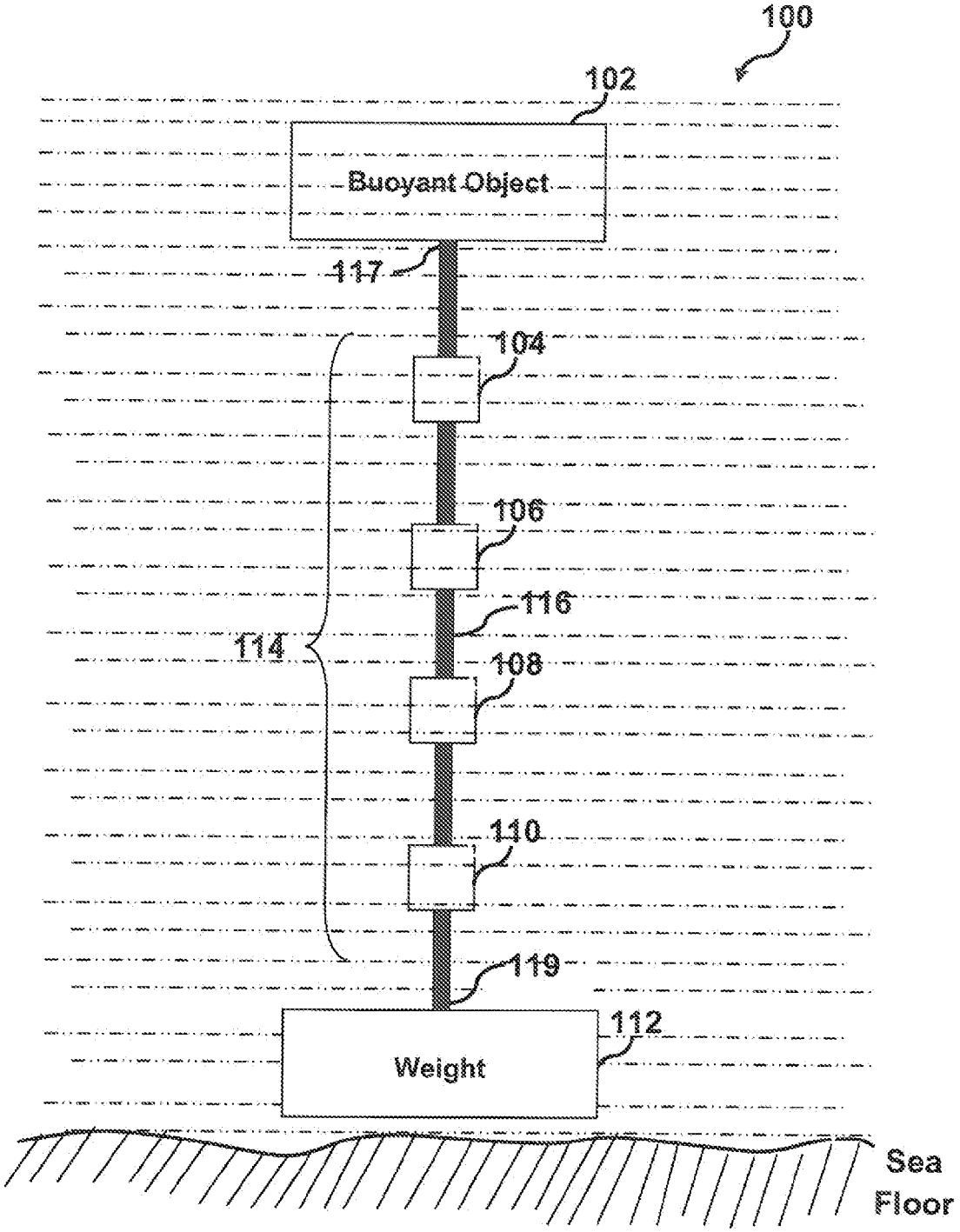
Figure 2:
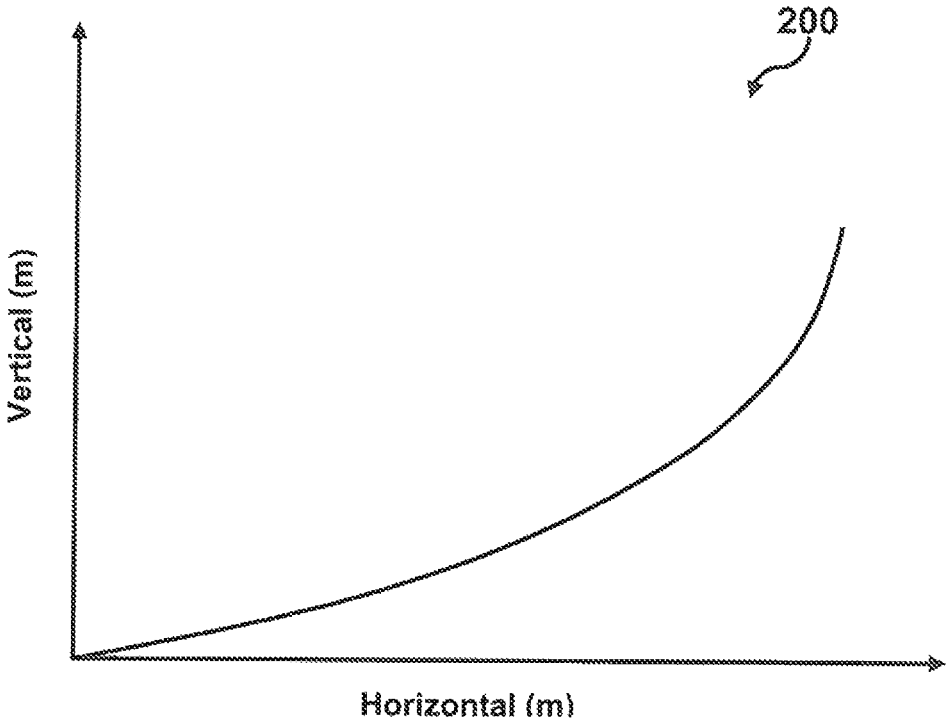
FIG. 2 Prior Art
FIG. 2 illustrates a graph showing distribution of traditional sensor array depicted in FIG. 1A and FIG. 1B in ocean current.

The particular values and configurations discussed in these non-limiting examples can be varied and are cited merely to illustrate at least one embodiment and are not intended to limit the scope thereof.

A system 300 for linearizing underwater sensor array 314 is disclosed in FIG. 3A. The sensor array 314 comprises a plurality of slightly negatively buoyant sensors 304, 306, 308 and 310 that are positioned along a cable 316. A buoyant object 302 is positioned at a shallow end 317 of cable 316. The total buoyancy of slightly buoyant sensors 304, 306, 308 and 310 maintains negative buoyancy of the sensor array 314 to keep it submerged. For arrays anchored to the sea floor, the acoustic array 314 comprises a plurality of slightly positively buoyant sensors 304, 306, 308 and 310 that are positioned along a cable 316. A weight 312 is positioned at the deep end 319 of the cable 316. The total buoyancy of the slightly positively buoyant sensors 304, 306, 308 and 310 maintains positive buoyancy of the sensor array 314 to keep it suspended in the water column. Distributing the buoyant elements throughout the length of the array 314 generates more consistent, uniformly distributed tension, enabling the sensor array 314 to maintain a linear shape in currents of all strengths and speeds. This array can be used to identify, locate and track objects using specialized algorithms known as beam forming algorithms.

Figure 4:
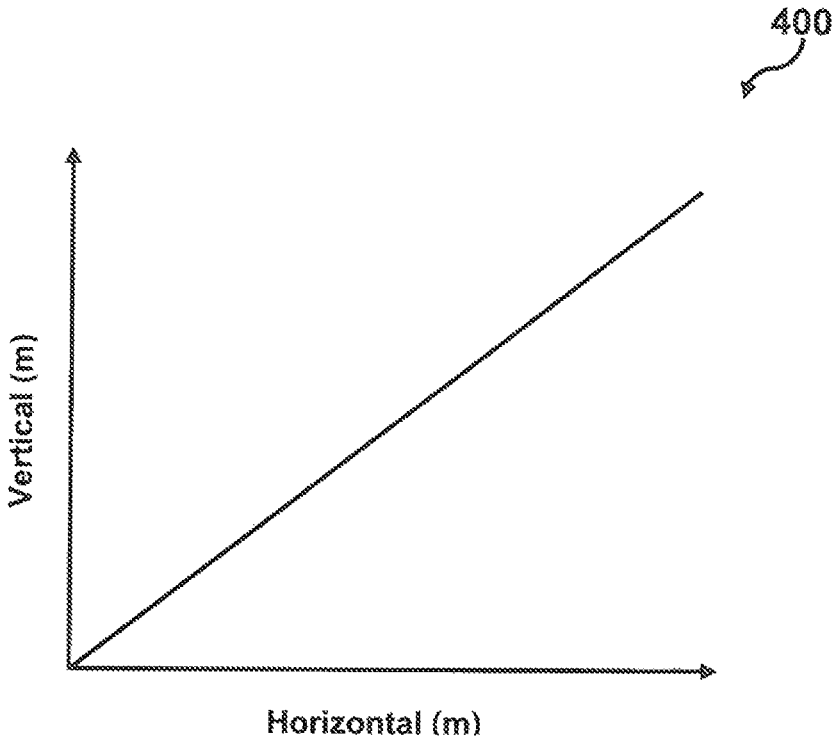
FIGS. 4-5 illustrate graphs showing distribution of sensor array in the same ocean current as depicted in FIG. 3A and FIG. 3B, in accordance with the disclosed embodiments.
Figure 5:
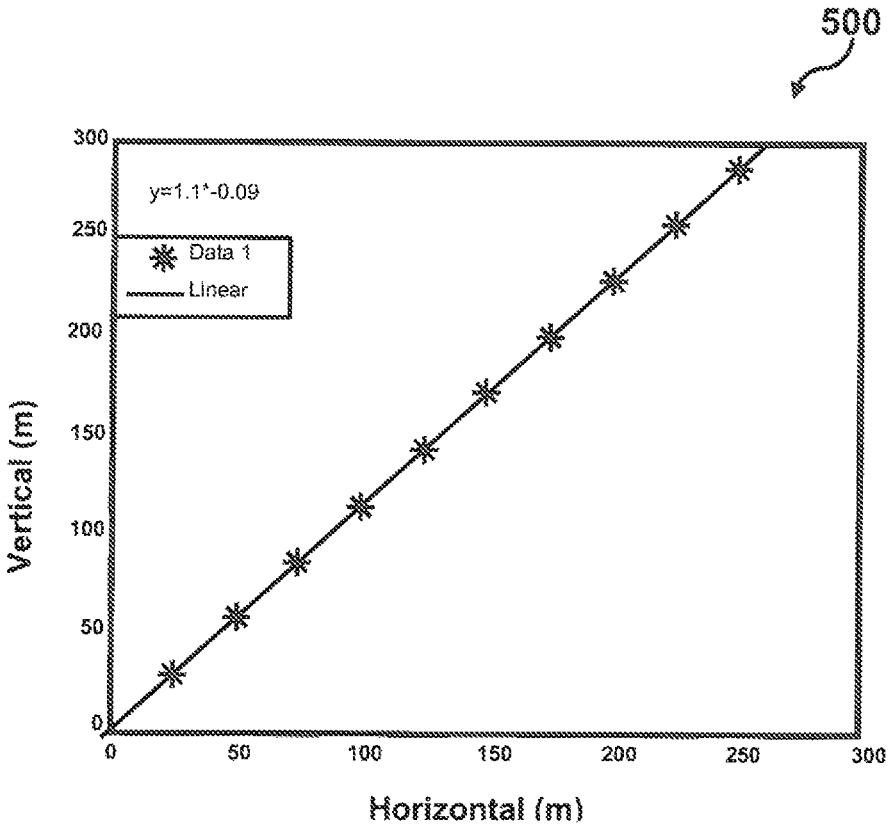

FIGS. 4-5 show substantially linear curves 400 and 500 of the acoustic array 314 depicted in FIG. 3A or FIG. 3B placed in a typical ocean current of fifty eight centimeters per second. The linearization is achieved by distributing buoyancy throughout the sensors in an array, rather than concentrating it at the top of the array, such that each sensor is slightly buoyant.

Figure 6:
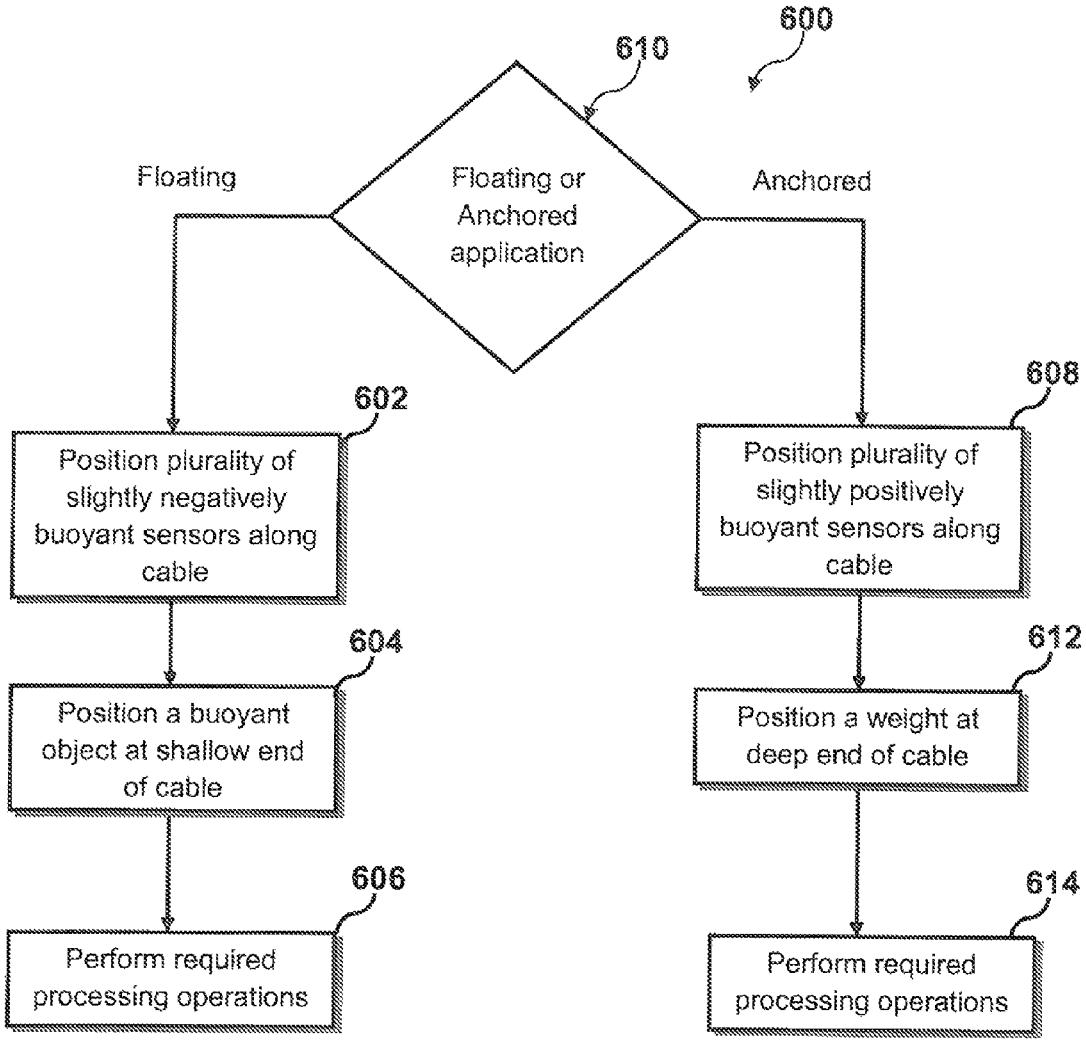
FIG. 6 illustrates a flow chart depicting the process of linearizing underwater sensor arrays depicted in FIG. 3A and FIG. 3B, in accordance with the disclosed embodiments.

FIG. 6 illustrates a flow chart 600 depicting the process of linearizing underwater sensor array depicted in FIG. 3A and FIG. 3B, in accordance with the disclosed embodiments. As said at block 610, type of application is selected, floating or anchoring. For selected floating type, as said at block 602, a plurality of slightly negatively buoyant sensors is placed along cable. Then as illustrated at block 604 a buoyant object is placed at shallow end of cable. Then as said at block 606 required processing operations are performed. For selected anchoring type, as said at block 608, a plurality of slightly positively buoyant sensors is placed along cable. Then as illustrated at block 612 a weight is attached at deep end of cable. Then as said at block 614 required processing operations are performed.

The present invention avoids complications in beam forming algorithms and signal processing due to non-linear arrays, thereby causing location estimates to be more accurate, improved identification, and increased processing efficiency.

While the present invention has been described in connection with a preferred embodiment, it is to be understood that other similar embodiments may be used or modifications and additions may be made to the described embodiment for performing the same function of the present invention without deviating therefrom. Therefore, the present invention should not be limited to any single embodiment.

What is claimed is:

1. An underwater sensor array apparatus comprising:

a plurality of sensors positioned along a cable, wherein said plurality of sensors are buoyant; and a buoyant object positioned at a shallow end of said cable for floating applications, wherein a total buoyancy of said buoyant object and said plurality of sensors results in a negative buoyancy of said sensor array and wherein said plurality of sensors uniformly distribute tension throughout the length of sensor array.

2. The apparatus of claim 1, wherein said plurality of sensors linearize said sensor array in underwater currents of all strengths and speeds.

3. The apparatus of claim 1, wherein said plurality of sensors are negatively buoyant.

4. The apparatus of claim 1, wherein said plurality of sensors are uniformly distributed throughout the length of said sensor array.

5. An underwater sensor array apparatus comprising:

a plurality of sensors positioned along a cable, wherein said plurality of sensors are buoyant; and a weight positioned at a deep end of said cable for anchoring to the sea floor, wherein a total buoyancy of said weight and said plurality of sensors results in a positive buoyancy of sensor array and wherein said plurality of sensors uniformly distribute tension throughout the length of sensor array.

6. The apparatus of claim 5, wherein said plurality of sensors linearize said sensor array in underwater currents of all strengths and speeds.

7. The apparatus of claim 5, wherein said plurality of sensors are positively buoyant.

8. The apparatus of claim 5, wherein said plurality of sensors are uniformly distributed throughout the length of said sensor array.

9. A method of linearizing underwater acoustic arrays comprising:

positioning a plurality of sensors along a cable, wherein said plurality of sensors are negatively buoyant; and positioning a buoyant object at a shallow end of said cable for floating applications, wherein said plurality of sensors uniformly distribute tension throughout the length of sensor array.

10. The method of claim 9, wherein said plurality of sensors linearize said sensor array in underwater currents of all strengths and speeds.

11. The method of claim 9, wherein said plurality of sensors are uniformly distributed throughout the length of said sensor array.

12. A method of linearizing underwater acoustic arrays comprising:

positioning a plurality of sensors along a cable, wherein said plurality of sensors are positively buoyant; and positioning a weight at a deep end of said cable for anchoring to the sea floor, wherein said plurality of sensors uniformly distribute tension throughout the length of sensor array.

13. The method of claim 12, wherein said plurality of sensors linearize said sensor array in underwater currents of all strengths and speeds.

14. The method of claim 12, wherein said plurality of sensors are uniformly distributed throughout the length of said sensor array.

15. The apparatus of claim 1, wherein the underwater sensor array uses a beam forming algorithm.

16. The apparatus of claim 5, wherein the underwater sensor array uses a beam forming algorithm.

* * * * *